US010040300B2

(12) United States Patent
Suzuki

(10) Patent No.: US 10,040,300 B2
(45) Date of Patent: Aug. 7, 2018

(54) PRINTING APPARATUS, PRINTING CONTROL METHOD FOR PRINTING APPARATUS, AND NON-TRANSITORY COMPUTER-READABLE RECORDING

(71) Applicant: CASIO COMPUTER CO., LTD., Tokyo (JP)

(72) Inventor: Shigeto Suzuki, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 15/385,104

(22) Filed: Dec. 20, 2016

(65) Prior Publication Data

US 2017/0253058 A1 Sep. 7, 2017

(30) Foreign Application Priority Data

Mar. 7, 2016 (JP) ..... 2016-043161

(51) Int. Cl.
*B41J 13/00* (2006.01)

(52) U.S. Cl.
CPC ..... *B41J 13/0009* (2013.01)

(58) Field of Classification Search
None
See application file for complete search history.

(56) References Cited

U.S. PATENT DOCUMENTS 5,069,556 A * 12/1991 Sasaki ..... B41J 19/202 346/139 R

FOREIGN PATENT DOCUMENTS

JP H10-35034 A 2/1998

* cited by examiner

*Primary Examiner* — Lisa M Solomon
(74) *Attorney, Agent, or Firm* — Fitch, Even, Tabin & Flannery LLP

(57) ABSTRACT

A printing apparatus includes a movement detector that detects a direction of movement of the printing apparatus relative to the printing medium, a printing unit that prints an image on the printing medium, and a processor. In a case where the movement of the printing apparatus in a first direction relative to the printing medium is detected by the movement detector, the processor causes the printing unit to print the image of a print subject on the printing medium; and after causing the printing unit to print the image of the print subject on the printing medium, in a case where the movement of the printing apparatus in a second direction differing from the first direction relative to the printing medium is detected by the movement detector, the processor executes a process indicating an occurrence of a printing error in printing of the image of the print subject on the printing medium by the printing unit.

15 Claims, 6 Drawing Sheets

PRINTING APPARATUS, PRINTING CONTROL METHOD FOR PRINTING APPARATUS, AND NON-TRANSITORY COMPUTER-READABLE RECORDING

CROSS-REFERENCE TO RELATED APPLICATION

This application is based upon and claims the benefit of priority from the prior Japanese Patent Application No. 2016-043161, filed on Mar. 7, 2016, the entire contents of which are incorporated herein by reference.

FIELD

This application relates generally to a printing apparatus, a printing control method for a printing apparatus and a non-transitory computer-readable recording medium.

BACKGROUND

A printing apparatus has been known that prints an image of a print subject on a printing medium in accordance with movement of the apparatus on the printing medium.

For example, in Unexamined Japanese Patent Application Kokai Publication No. H10-35034, a manual printing apparatus is disclosed that performs printing on a recording medium by being manually caused to move on the recording medium.

To explain more specifically, the manual printing apparatus disclosed in the aforementioned Literature performs printing by embellishing characters already printed, when the apparatus is caused to move in a direction opposite the normal printing direction.

The manual printing apparatus described above can freely and easily print at a variety of positions on a variety of printing media. On the other hand, a printing error caused by rubbing, scraping, bending and/or the like occurs easily because a user manually causes the apparatus body to move.

For that reason, improving operability such that ease of use is not lost to the extent possible even if a printing error occurs is desired.

SUMMARY

The present disclosure offers the advantage of being able to provide a printing apparatus, a printing control method for a printing apparatus and a non-transitory computer-readable recording medium capable of improving operability when a printing error occurs, in a printing apparatus that performs printing on a printing medium in accordance with movement of the printing apparatus relative to the printing medium.

A printing apparatus according to the present disclosure obtaining the above-described advantages includes:

a movement detector that detects a direction of movement of the printing apparatus relative to a printing medium;

a printing unit that prints an image on the printing medium; and a processor;

wherein the processor:

causes the printing unit to print the image of a print subject on the printing medium, in a case where the movement of the printing apparatus in a first direction relative to the printing medium is detected by the movement detector; and executes a process indicating an occurrence of a printing error in printing of the image of the print subject on the printing medium by the printing unit, in a case where the movement of the printing apparatus in a second direction differing from the first direction relative to the printing medium is detected by the movement detector after causing the printing unit to print the image of the print subject on the printing medium.

A printing control method of a printing apparatus according to the present disclosure obtaining the above-described advantages includes:

a movement detection step of detecting a direction of movement of the printing apparatus relative to a printing medium;

a printing step of printing an image of a print subject on the printing medium, in a case where the movement of the printing apparatus in a first direction relative to the printing medium is detected in the movement detection step; and a correction process step of executing a process indicating an occurrence of a printing error in printing the image of the print subject on the printing medium, in a case where the movement of the printing apparatus in a second direction differing from the first direction relative to the printing medium is detected in the movement detection step after the image of the print subject is printed on the printing medium in the printing step.

In a non-transitory computer-readable recording medium on which a printing control program for a printing apparatus obtaining the above-described advantage is stored;

the printing apparatus comprises a movement detector for detecting a direction of movement of the printing apparatus relative to a printing medium, a printing unit for printing an image on the printing medium; and a processor;

and the printing control program causes the processor to:

print the image of a print subject on the printing medium by the printing unit, in a case where the movement of the printing apparatus in a first direction relative to the printing medium is detected by the movement detector; and execute a process indicating an occurrence of a printing error in printing of the image of the print subject on the printing medium by the printing unit, in a case where the movement of the printing apparatus in a second direction differing from the first direction relative to the printing medium is detected by the movement detector, after the image of the print subject on the printing medium is printed by the printing unit.

BRIEF DESCRIPTION OF THE DRAWINGS

A more complete understanding of this application can be obtained when the following detailed description is considered in conjunction with the following drawings, in which.

DETAILED DESCRIPTION

Figure 1:
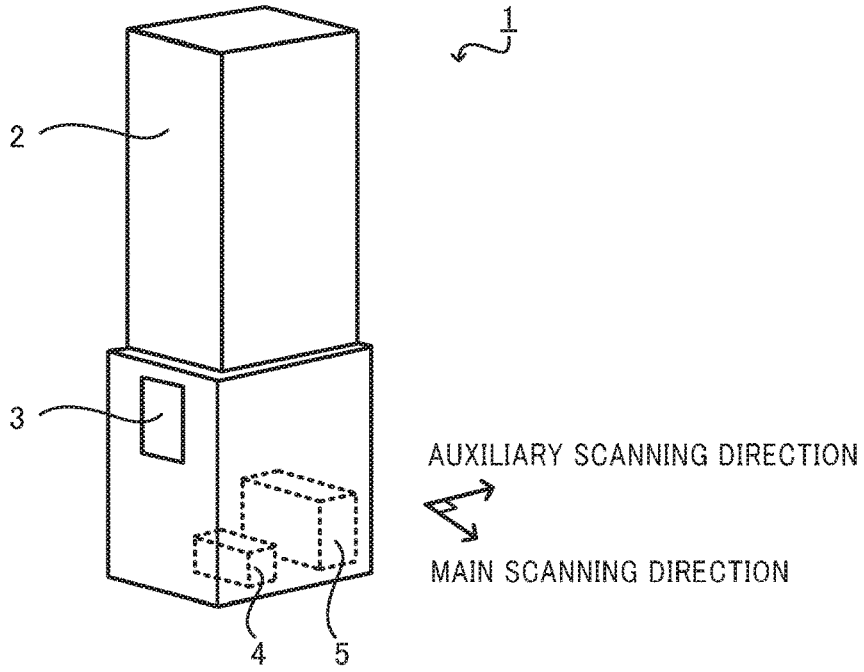
FIG. 1 is a drawing showing an external view of a printing apparatus according to an exemplary embodiment of the present disclosure.

Exemplary embodiments of a printing apparatus and printing control method according to the present disclosure will be described in detail with reference to the drawings.

In the drawings, same or corresponding parts are labelled with the same reference symbols.

Figure 2:
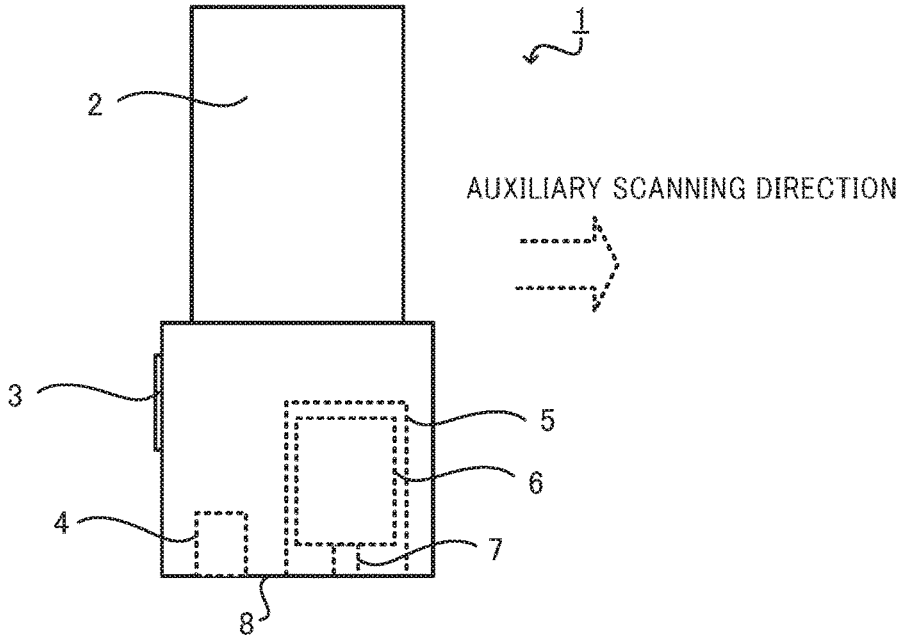
FIG. 2 is a side view of the printing apparatus.

A printing apparatus 1 according to the present disclosure is configured as shown in FIG. 1 and FIG. 2.

The printing apparatus 1 is a printing apparatus capable of printing an image that is a print subject on a printing medium, by being held by a user by hand such that a bottom surface 8 is moved (scanned) smoothly on the printing medium such as a paper, a box and/or the like.

A printing apparatus of this type is called a manual scanning printing apparatus, a handy printer, a direct printer and/or the like.

The printing medium is for example printing paper, labels, cardboard and/or the like. The printing medium is also call a recording medium, a printing object and/or the like. The material of the printing medium is not limited to paper, and for example may be anything to which ink can adhere, such as film, textile, and/or the like.

The shape of the printing medium is not limited to a flat shape such as a sheet, a tape and/or the like, but may also be a three-dimensional shape such as a box, a bottle and/or the like. In other words, because conveying the printing medium as with a stationary printing apparatus is not necessary, the manual scanning printing apparatus 1 can print on printing medium of any shape.

The image that is the print subject is an image drawn on the printing medium at the time of printing, and for example is text, figures, symbols, designs, pictures or a combination of these, and/or the like. The image that is the print subject is also called a print image, a print pattern and/or the like.

As shown in FIG. 1, the printing apparatus 1 includes a gripper 2 where the apparatus is held by the user during printing and/or the like, a printing start button 3 that receives an instruction to begin printing, a movement detector 4 that detects movement of the printing apparatus 1, and a printing unit 5 that performs printing.

A casing of the printing apparatus 1 that includes the gripper 2 is formed in a quadrangular prism shape so as to be easy for the user to grasp by hand.

The printing start button 3 is a press button disposed on a side surface of the printing apparatus 1, and receives from the user an instruction to being printing.

The user, after pressing the printing start button 3, causes the printing apparatus 1 to move (scan) on a desired printing medium. Through this, printing on the printing medium is performed.

When the printing apparatus 1 is caused to move on the printing medium without the printing start button 3 being pressed, printing is not performed.

The movement detector 4 is disposed exposed on the bottom surface 8 of the printing apparatus 1, and includes an optical sensor that detects movement of the printing apparatus 1 when the bottom surface 8 of the printing apparatus 1 moves on the printing medium.

To explain more specifically, the movement detector 4 reads, through an optical sensor, images from light emitted to the printing medium from a light-emitting diode (LED) and reflected by the printing medium, and detects the amount of movement and direction of movement of the printing apparatus 1 on the basis of changes in the images read.

The printing unit 5 is disposed exposed on the bottom surface 8 of the printing apparatus 1, and functions as printing means for printing an image that is a print subject on the printing medium, in accordance with movement of the apparatus on the printing medium.

The printing unit 5 prints an image of the print subject on the printing medium using an inkjet format in which ink is atomized and sprayed directly onto the printing medium.

As shown in FIG. 2, the printing unit 5 includes an ink tank 6 loaded with ink, and a print head (inkjet head) 7 that discharges the ink loaded into the ink tank 6. The ink tank 6 and the print head 7 are together called an ink cartridge.

The ink cartridge is replaceable by the user and is appropriately replaced as necessary when the ink is all gone, or to print with a different color.

The print head 7 is a printing mechanism that discharges ink loaded into the ink tank 6 and performs printing on the printing medium.

In the print head 7, a plurality of nozzles is lined up along a main scanning direction and an auxiliary scanning direction.

The print head 7 has, for example, a thermal format, and ink in the plurality of nozzles is heated by a heater so that bubbles form, and through the bubbles that form the ink is discharged toward the printing medium (the vertically downward direction) from each of the plurality of nozzles. Through this, the print head 7 prints an image of the print subject on the printing medium. The print head 7 may also have a piezo format and print an image of the print subject on the printing medium by discharging ink using a piezo device.

Figure 3:
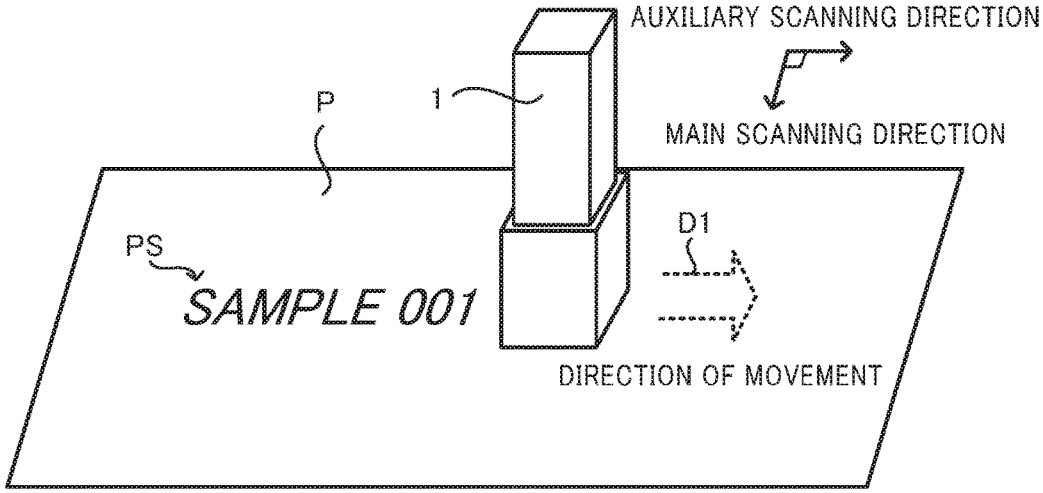
FIG. 3 is a first drawing showing an example of printing by the printing apparatus.

FIG. 3 shows an example of a case in which the character string "sample 001" is printed on a printing medium P by the printing apparatus 1.

As shown in FIG. 3, when printing, the user grasps the gripper 2 and causes movement in an auxiliary scanning direction indicated by the arrow in FIG. 1 while causing the bottom surface 8 of the printing apparatus 1 to make contact with the printing medium P.

Whereupon, movement of the printing apparatus 1 is detected by the movement detector 4, and ink is discharged from the print head 7 of the printing unit 5 in accordance with the detected movement.

As a result, a print image PS of a print subject (for example, the character string "sample 001" shown in FIG. 3) is printed on the printing medium P.

Figure 4:
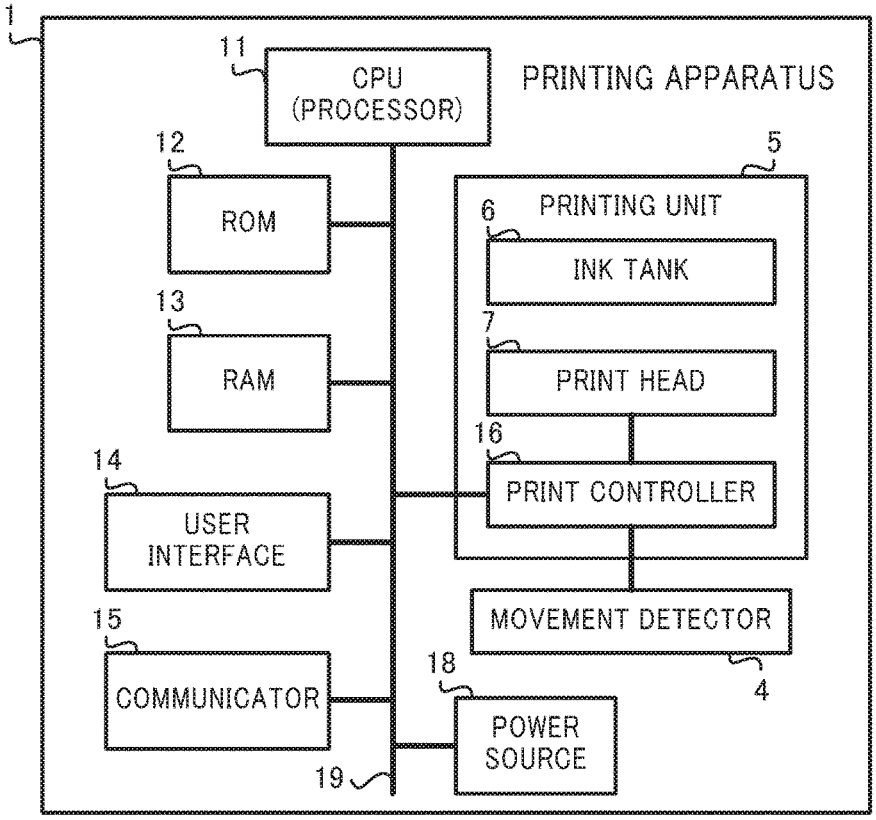
FIG. 4 is a block diagram showing an electrical configuration of the printing apparatus.

FIG. 4 shows an electrical configuration of the printing apparatus 1.

As shown in FIG. 4, the printing apparatus 1 includes a central processing unit (CPU: processor) 11, a read only memory (ROM) 12, a random access memory (RAM) 13, a user interface 14, a communicator 15, a print controller 16 and a power source 18.

The CPU (processor) 11 is, for example, a microprocessor and/or the like, and is a central calculation processor that executes various processes and calculations.

The CPU 11 is also called a central processing unit, a central calculation unit, a processor and/or the like.

The CPU 11 is connected to each part of the printing apparatus 1 via a system bus 19 that is a transfer path for transferring commands and data, and comprehensively controls the printing apparatus 1 as a whole.

The ROM 12 houses various programs and data used by the CPU 11 in executing various types of processes.

The ROM 12 stores, for example, data for displaying and printing, such as text, symbols, pictorial symbols and/or the like.

Furthermore, the ROM 12 stores tables that determine various types of settings in printing.

The CPU 11 operates in accordance with programs and data stored in the ROM 12.

The RAM 13 functions as a work area for the CPU 11.

The RAM 13 stores data the CPU 11 generates or acquires by executing various types of programs.

The CPU 11 temporarily writes programs or data in the RAM 13, and executes various types of processes while appropriately referencing the written programs or data.

The printing apparatus 1 includes non-volatile memory such as flash memory and/or the like. This kind of non-volatile memory, the ROM 12 and the RAM 13 are together called storage devices, memory and/or the like.

The user interface 14 includes an input receiver such as an input key, a button, a switch, a touch pad, a touch panel and/or the like, for example, and a display such as a liquid crystal display (LCD) panel, an LED and/or the like.

The user interface 14 receives various manipulation instructions from users via the input receiver, and transmits the received manipulation instructions to the CPU 11.

Furthermore, the user interface 14 acquires various types of information from the CPU 11 and displays on the display images showing the acquired information.

The communicator 15 includes a communication interface with which the printing apparatus 1 communicates with an external device such as a personal computer (PC), a smartphone and/or the like (hereafter referred to as "PC and/or the like").

The communicator 15 communicates with the PC and/or the like via a Universal Serial Bus (USB) and/or the like.

Or, the communicator 15 communicates with the PC and/or the like via wireless communication such as a wireless local area network (LAN) such as Wireless Fidelity (Wi-Fi) and/or the like, or Bluetooth® and/or the like, for example.

Furthermore, the communicator 15 acquires various types of data including print data from the PC and/or the like, via USB, wireless LAN, Bluetooth® and/or the like, under control of the CPU 11.

The print controller 16 controls discharging of ink from the print head 7 at the time of printing.

To explain more specifically, when movement of the printing apparatus 1 is detected by the movement detector 4, the print controller 16 outputs to the print head 7 contents of print data stored in the RAM 13 in accordance with the detected movement. Furthermore, the print controller 16 controls electric current dots of the print head 7 through a driver integrated circuit (IC) disposed internally, and causes ink to be discharged from the print head 7. Through this, printing is performed.

The structure including the ink tank 6, the print head 7 and the print controller 16 is called the printing unit 5.

The power source 18 includes a battery, a voltage detector and/or the like, and creates and supplies power necessary for the various components.

The power source 18 is disposed internally in the gripper 2, for example.

The printing apparatus 1 includes a timer such as a real time clock (RTC) and/or the like that continues to keep time even when the power source is off.

Figure 5:
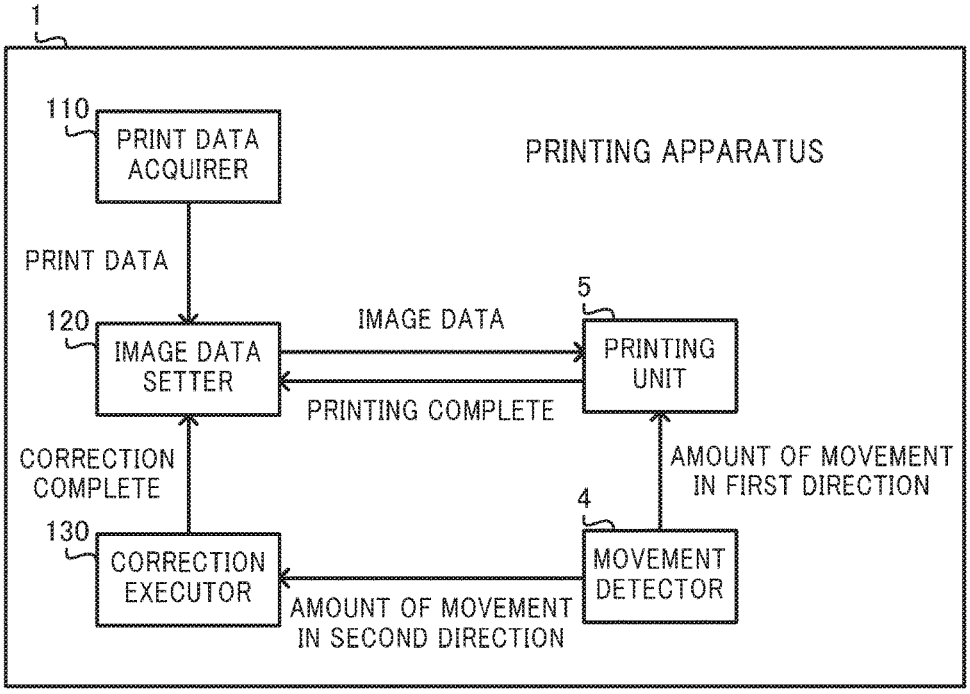
FIG. 5 is a block diagram showing a functional configuration of the printing apparatus.

FIG. 5 shows a functional configuration of the printing apparatus 1.

As shown in FIG. 5, the printing apparatus 1 functionally includes a print data acquirer 110, an image data setter 120 and a correction executor 130.

The CPU (processor) 11 functions as each of the above-described components by exercising control to read a program stored in the ROM 12 into the RAM 13 and execute that program.

Below, various functions of the printing apparatus 1 are described with reference to FIG. 5 through FIG. 9.

The print data acquirer 110 acquires print data of the print image PS to be printed on the printing medium P.

The print data is data including information such as image data including the print image PS to be drawn on the surface of the printing medium P, the print size of the print image PS, and/or the like.

The print data of the print image PS is generated by receiving manipulation instructions from the user via a print driver preinstalled for example in the PC and/or the like.

The print data acquirer 110 acquires, as print data, a first type of print data for which the print image PS does not change each time printing is done, and a second type of print data for which at least a portion of the print image PS changes each time printing is done.

The user can generate either or both of these two types of print data with the PC and/or the like, and transmit the data to the printing apparatus 1.

The first type of print data is so-called normal print data.

The user generates the first type of print data with the PC and/or the like, and transmits the data to the printing apparatus 1.

The printing apparatus 1 can repeatedly perform printing of the print image PS having the same content, on the basis of the transmitted print data.

In contrast to this, the second type of print data is print data for realizing a so-called automatic numbering function.

The automatic numbering function is a function for printing by changing, each time printing is done, a numerical value in the number, character string, time and/or the like included in the print image PS to be printed.

Through the automatic numbering function, printing while continuously changing a lot number, a serial number and/or the like in a factory, warehouse and/or the like, or displaying consecutive numbers on a plurality of documents, and/or the like, can be easily accomplished.

When the automatic numbering function is used, the user generates with the PC and/or the like the second type of print data including an invariable portion of data and a variable portion of data in the print image PS, and transmits the data to the printing apparatus 1. The data contents of the variable portion is for example a variable portion of an initial value, a value that changes with each printing, coordinates within the printing range, and/or the like.

For example, in the character string "sample 001" of the print image PS of the print subject shown in FIG. 3, when the character string "sample" is set as the invariable portion and the character string "001" is set as the variable portion, each time printing is done, the number in the variable portion (consecutive number portion) is successively incremented, such as "sample 001", "sample 002", "sample 003", and so forth.

The print data acquirer 110 acquires this kind of first type of print data and second type of print data from the PC and/or the like via the communicator 15.

Or, the user can directly input contents of print data to the printing apparatus 1, via the input receiver of the user interface 14.

The print data may also be stored in advance in the memory of the ROM 12 and/or the like of the printing apparatus 1.

In such cases, the print data acquirer 110 acquires the print data from the user interface 14 or the ROM 12.

In this manner, the functions of the print data acquirer 110 are realized by the CPU 11 working together with the communicator 15, the user interface 14, the ROM 12 and/or the like.

At this time, the print data acquirer 110 functions as print data acquisition means.

The print data acquirer 110, upon acquiring the print data, transmits the acquired print data to the image data setter 120.

The image data setter 120 sets the image data for printing, on the basis of the print data acquired by the print data acquirer 110.

Functions of the image data setter 120 are realized by the CPU 11 working together with the ROM 12, the RAM 13 and/or the like.

At this time, the image data setter 120 functions as image data setting means.

To explain more specifically, when the first type of print data for which the print image PS does not change each time printing is done is acquired by the print data acquirer 110, the image data setter 120 sets the print data of the print image PS included in the acquired print data as the image data for printing, without any changes.

In contrast, when the second type of print data for which at least a portion of the print image PS changes each time printing is done is acquired by the print data acquirer 110, the image data setter 120 sets the numerical value of the variable portion included in the acquired print data to an initial value.

For example, if the initial value of the numerical value of the variable portion is "001", the image data setter 120 sets the numerical value of the variable portion to "001."

Then, the image data setter 120 combines the image data of the variable portion for which the numerical value was set to the initial value with the image data of the invariable portion.

Through this, the image data setter 120 generates the image data "sample 001" for example as shown in FIG. 3, and sets the generated image data as the image data for printing.

The movement detector 4 detects movement in a first direction of the apparatus (the printing apparatus 1) on the printing medium P.

Here, the first direction is a predetermined direction for the printing apparatus 1 to print, and is one direction in an auxiliary scanning direction of the printing apparatus 1.

In the example in FIG. 3, the first direction is a direction indicated by a dotted arrow D1, moving from left to right in the drawing.

Detecting movement of the apparatus includes detecting the amount of movement and the direction of movement of the apparatus.

To explain more specifically, as a procedure for starting printing, the user presses the printing start button 3.

Then, as shown in FIG. 3, the user causes the printing apparatus 1 to slide while the bottom surface 8 of the printing apparatus 1 contacts the printing medium P.

When the printing apparatus 1 moves on the printing medium P in this manner, the movement detector 4 detects the amount of movement and the direction of movement thereof through an optical sensor. At this time, the movement detector 4 functions as movement detection means.

When movement is detected by the movement detector 4, the printing unit 5 prints the image of the print subject on the printing medium P in accordance with the detected movement.

To explain more specifically, when movement of the printing apparatus 1 in the first direction is detected by the movement detector 4, the printing unit 5 prints the image of the print subject in accordance with the image data set by the image data setter 120.

For example, as shown in FIG. 3, the printing unit 5 discharges ink from the print head 7 in accordance with the amount of movement of the printing apparatus 1, and prints the print image PS of "sample 001" on the printing medium P.

When one round of printing is completed, the printing unit 5 notifies the image data setter 120 that printing has been completed.

To explain in greater detail, when the print data acquired by the print data acquirer 110 is the first type of print data for which the print image PS does not change each time printing is done, the printing unit 5 prints the same image as the image of the print subject, each time printing is done.

In other words, the printing unit 5 prints the same print image PS each time movement of the printing apparatus 1 in the first direction is detected by the movement detector 4.

Figure 6:
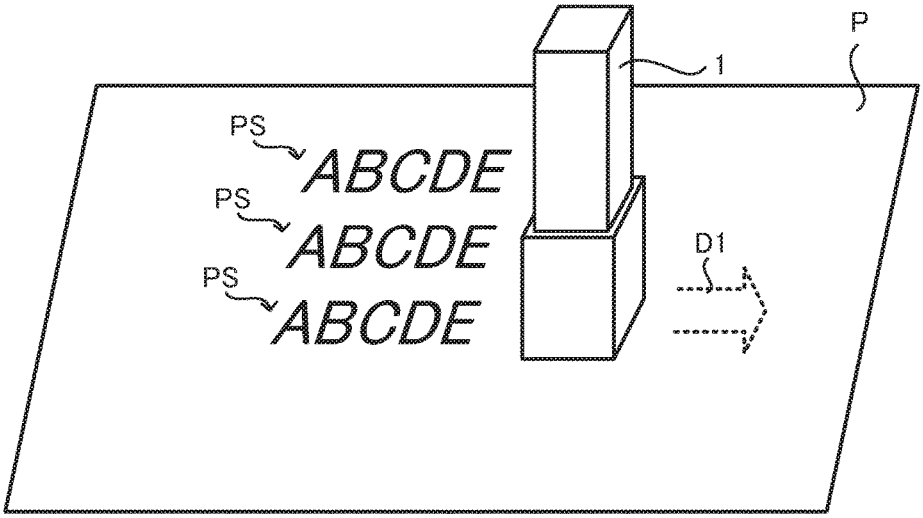
FIG. 6 is a second drawing showing an example of printing by the printing apparatus.

FIG. 6 shows an example of a case in which the print image PS that is the character string "ABCDE" is printed in accordance with the first type of print data.

When the first type of print data is acquired by the print data acquirer 110, the image data setter 120 does not change the image data for printing, even if printing by the printing unit 5 is completed.

Consequently, after the completion of printing, the printing apparatus 1 continues to remain in a printable state in accordance with the same image data.

As a result, as shown in FIG. 6, when the first type of print data is acquired, the printing unit 5 prints the same print image PS that is the character string of "ABCDE" on the printing medium P each time movement of the printing apparatus 1 is detected.

On the other hand, when the print data acquired by the print data acquirer 110 is the second type of print data for which at least a portion of the print image PS changes each time printing is done, the printing unit 5 prints a different image as the print image PS each time printing is done.

In other words, after the first image is printed as the print image PS, the printing unit 5 prints a second image that differs from the first image as the print image PS on the printing medium P, in accordance with movement in the first direction, when movement of the printing apparatus 1 in a second direction that is the opposite direction to the first direction is not detected and movement in the first direction is again detected by the movement detector 4.

Following this, the printing unit 5 prints a third image, and a fourth image, and so forth, in sequence each time movement of the printing apparatus 1 in the first direction is detected by the movement detector 4.

Figure 7:
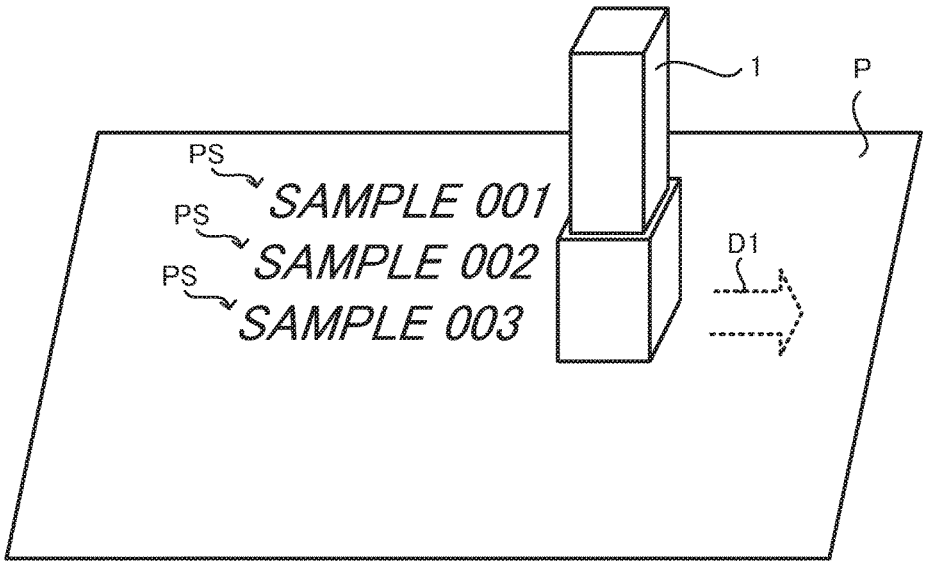
FIG. 7 is a third drawing showing an example of printing by the printing apparatus.

FIG. 7 shows a case when a character string including a consecutive number portion is printed in accordance with the second type of print data.

When the second type of print data is acquired by the print data acquirer 110, the image data setter 120, after the print image PS by the printing unit 5 is printed, generates new image data in which the variable portion of the contents is altered, out of the second type of print data.

For example, in the case of "sample 001", when image data including the consecutive number portion of "001" as the variable portion is printed, the image data of "sample 002" in which the numerical value of the consecutive number portion has been incremented is generated and set as the image data for printing.

As a result, as shown in FIG. 7, each time movement of the printing apparatus 1 in the first direction is detected, the printing unit 5 prints on the printing medium P the image of a character string the numerical value of the consecutive number portion of which has been incremented one at a time, such as "sample 001", "sample 002", "sample 003", and so forth, as the print image PS.

When a plurality of rounds of printing is performed, printing of the same or different images a plurality of times on one printing medium P as shown in FIG. 6 and FIG. 7 is possible, and printing of the same or different images on a plurality of different printing media is also possible.

For example, when printing the same name, date and/or the like on each of a plurality of products, by changing the printing medium on which the user causes the printing apparatus 1 to move each time printing is done, printing images with the same contents on differing printing media is possible.

For example, when printing differing management numbers, product numbers and/or the like on each of a plurality of products, by changing the printing medium on which the user causes the printing apparatus 1 to move each time printing is done, printing images with different contents on the differing printing media is possible.

We now return to the explanation of the functional configuration of the printing apparatus 1 shown in FIG. 5.

The correction executor 130 executes a predetermined process when a printing error occurs in printing by the printing unit 5.

To explain more specifically, after the printing unit 5 has printed an image, when movement of the printing apparatus 1 in a second direction that is the opposite direction to the first direction on the printing medium P is detected by the movement detector 4, the correction executor 130 executes a process indicating an occurrence of a printing error in printing by the printing unit 5.

The function of the correction executor 130 is realized by the CPU 11 working together with the print controller 16, the printing unit 5, the movement detector 4 and/or the like. At this time, the correction executor 130 functions as correction execution means.

Figure 8:
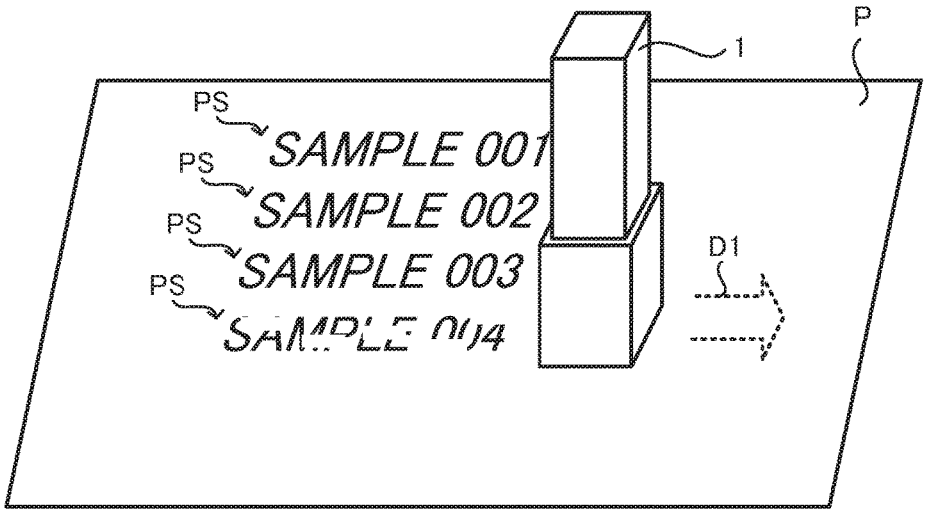
FIG. 8 is a fourth drawing showing an example of printing by the printing apparatus.
Figure 9:
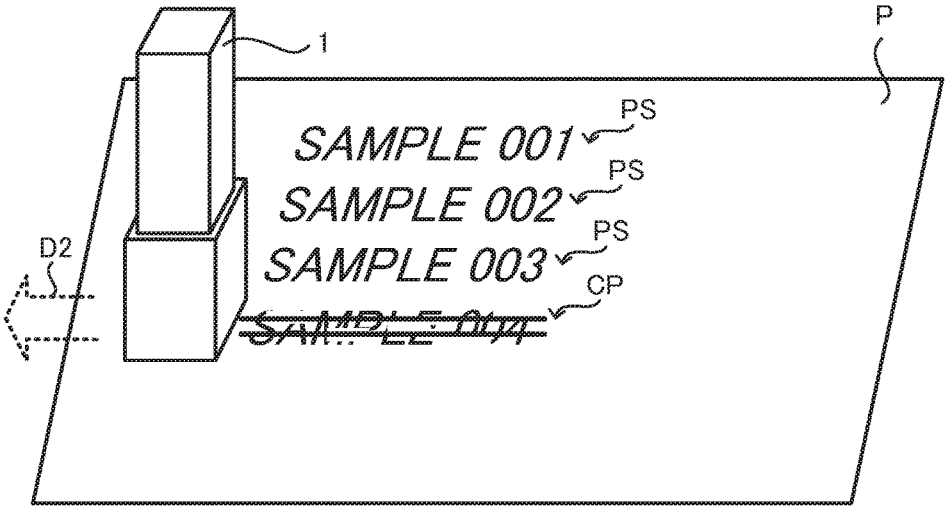
FIG. 9 is a fifth drawing showing an example of printing by the printing apparatus.

FIG. 8 and FIG. 9 show examples of a case in which a printing error occurred.

Below, a case will be described in which when the character string "sample 004" was printed, a printing error (that is to say, an error in printing) occurred in that the characters were not printed normally, for example due to rubbing of the surface printed, scraping at the time of printing, warping or bending of the movement path when the printing apparatus 1 was moved, and/or the like, as shown in FIG. 8.

When this kind of printing error occurs, the user causes the printing apparatus 1 to move in a second direction opposite to the first direction while still holding the printing apparatus 1 so as to contact the printing medium P. Here, the second direction is a predetermined direction of printing of the printing apparatus 1, and is an auxiliary scanning direction of the printing apparatus 1 and the direction opposite the predetermined first direction in which the printing apparatus 1 prints.

In the example of FIG. 9, the second direction is the direction indicated by a dotted arrow D2 and is the direction moving from right to left in the drawing.

When movement of the printing apparatus 1 in the second direction is detected by the movement detector 4, the correction executor 130 executes a printing process that causes the printing unit 5 to print a correction image CP in accordance with movement in the second direction, as a process indicating that the immediately prior printing by the printing unit 5 was a printing error.

The correction image CP is an image having a shape or pattern making that fact that the printed image is not the correct printed image easily recognizable by the user.

The correction image CP is for example correction lines including double lines.

More specifically, as shown in FIG. 9, the correction executor 130 executes a printing process that causes the printing unit 5 to print the correction lines through double lines on top of the image already printed, as the correction image CP.

That is to say, the correction executor 130 causes ink to be discharged from the print head 7 in accordance with the amount of movement of the printing apparatus 1 in the second direction, and causes double lines to be printed as the correction image CP on top of the print image PS of "sample 004" that has already been printed.

In this manner, by printing correction lines as the correction image CP, the user can easily recognize an occurrence of a printing error in printing at the location where the correction lines were printed.

When printing of the correction image CP is completed, the correction executor 130 notifies the image data setter 120 that printing of the correction image CP has been completed.

Upon receiving notification of correction completion from the correction executor 130, the image data setter 120 sets as the image data for printing the image data of the print image PS that was printed immediately prior.

In other words, the image data setter 120 sets the image data for printing by making the contents of the variable portion of the print data the same as at the printing of the print image PS immediately prior, so that the same image as the print image PS printed immediately prior can again be printed.

After the correction image CP is printed, when the printing apparatus 1 is caused to move again in the first direction, the printing unit 5 prints the same image as the print image PS the previous time.

In other words, when movement of the printing apparatus 1 in the second direction is detected after the first image is printed as the print image PS and then movement in the first direction again is detected by the movement detector 4, the printing unit 5 again prints the first image on the printing medium P in accordance with the movement in the first direction.

Figure 10:
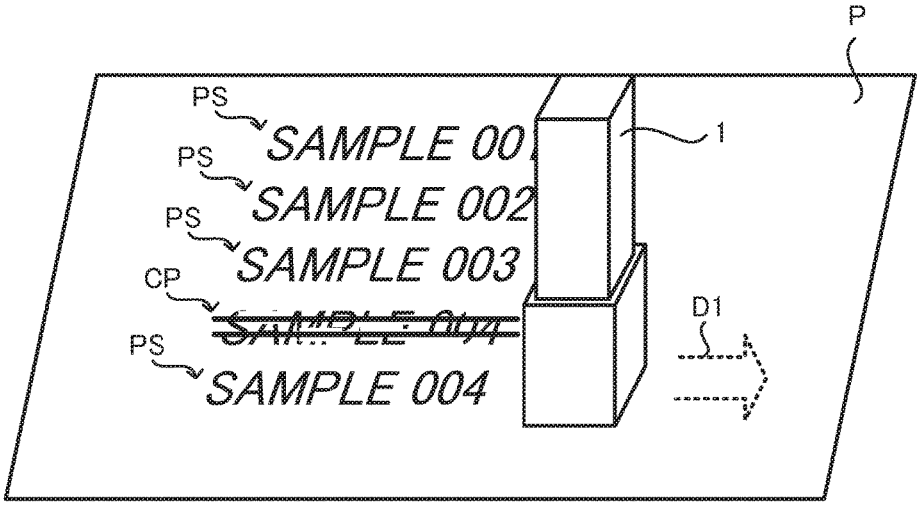
FIG. 10 is a sixth drawing showing an example of printing by the printing apparatus.

FIG. 10 shows an example of a case in which the printing apparatus 1 is again caused to move in the first direction after correction lines as the correction image CP is printed.

As shown in FIG. 10, after a printing error occurs when printing the character string of "sample 004", the printing apparatus 1 is caused to move in the second direction and the correction lines are printed, when the printing apparatus 1 is again caused to move in the first direction, the printing unit 5 again prints the character string of "sample 004" as the print image PS.

In other words, the printing unit 5 reprints the print image PS with the same content as before the correction lines were printed as the correction image CP, without changing the numerical value of the consecutive number portion.

Through this, the user can again perform printing of the same contents of the printing where the error occurred, without going through the trouble of resetting the consecutive numbers.

In contrast, when movement of the printing apparatus 1 in the first direction is detected by the movement detector 4 without movement in the second direction being detected after the first image is printed as the print image PS, the printing unit 5 prints a second image that differs from the first image as the print image PS on the printing medium P. In other words, when correction lines are not printed as the correction image CP, the printing unit 5 prints the image to be printed next after changing the variable portion of the print data as normal.

To explain more specifically, each time the printing apparatus 1 is moved in the first direction, the printing unit 5 prints a character string in which the numerical value of the consecutive number has been increased by one as the print image PS on the printing medium P, for example as in "sample 001", "sample 002", "sample 003" and so forth as shown in FIG. 7.

In this manner, when a printing error does not occur, printing of the print image PS in which the numerical value of the consecutive number portion has been automatically incremented can be continuously performed.

The flow of the printing process executed in the manual scanning printing apparatus 1 as described above will be described with reference to the flowchart shown in FIG. 11.

Figure 11:
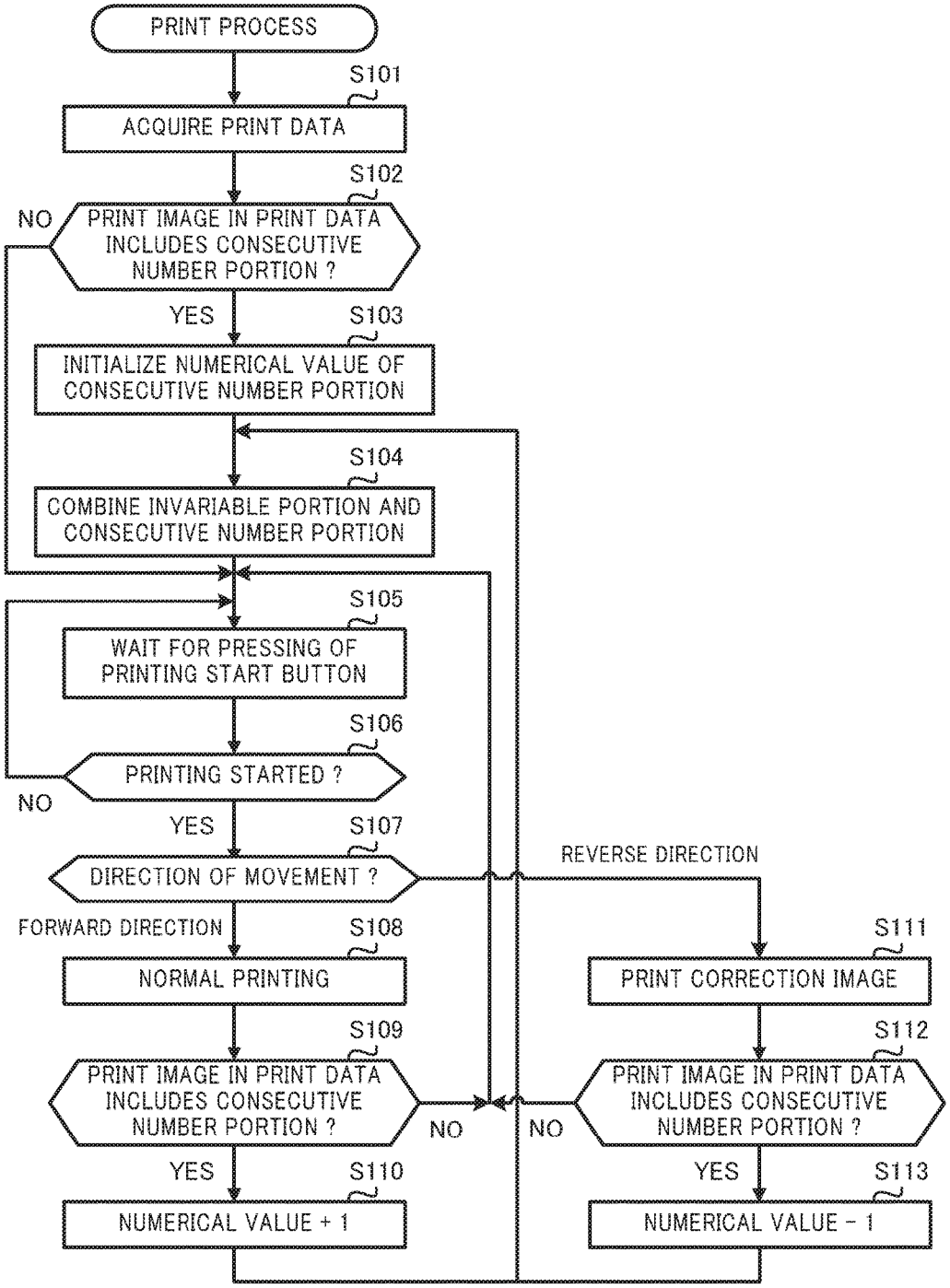
FIG. 11 is a flowchart showing a flow of printing processes executed in the printing apparatus.

The printing process shown in the flowchart of FIG. 11 starts when the CPU 11 acquires print data for the print image PS from the PC and/or the like (step S101), when the printing apparatus 1 is waiting in a printable status.

In step S101, the CPU 11 functions as the print data acquirer 110.

When the print data is acquired, the CPU 11 determines whether or not the print image PS in the acquired print data includes a consecutive number portion (step S102).

To explain more specifically, the CPU 11 determines whether the acquired print data is the first type of print data in which the print image PS does not change each time printing is done, or is the second type of print data in which the numerical value of the consecutive number portion of at least part of the print image PS changes each time printing is done.

When the CPU 11 determines that the print image PS in the acquired print data includes a consecutive number portion (step S102: Yes), the CPU 11 initializes the numerical value of the consecutive number portion (step S103).

For example, if the initial value of the numerical value of the consecutive number is "001", the CPU 11 sets the numerical value of the consecutive number to "001". If the initial value of the numerical value of the consecutive number is another value, the numerical value of the consecutive number portion is set to that other value.

When the numerical value of the consecutive number portion is initialized, the CPU 11 combines the invariable portion and the consecutive number portion of the print image PS (step S104).

To explain more specifically, the CPU 11 combines the image data of the consecutive number portion whose numerical value has been initialized with the image data of the invariable portion of the print image PS.

Through this, the CPU 11 generates the image data of "sample 001" and sets the generated image data as the image data for printing, for example as shown in FIG. 3.

In step S102 through step S104, the CPU 11 functions as the image data setter 120.

In contrast, when the determination is that the print image PS in the acquired print data does not include a consecutive number portion (step S102: No), combining the image data of the consecutive number portion with the image data of the invariable portion of the print image PS is not necessary.

Consequently, the CPU 11 omits the processes of step S103 and step S104, and sets the image data included in the acquired print data as the print data for printing, without change.

When the image data for printing is set in this manner, the CPU 11 waits for pressing of the printing start button 3 (step S105).

Then, the CPU 11 determines whether or not printing has been started (step S106).

To explain more specifically, as a procedure for starting printing, the user presses the printing start button 3, and following that causes the printing apparatus 1 to move in the auxiliary scanning direction while causing the bottom surface 8 of the printing apparatus 1 to make contact with the printing medium P.

Consequently, the CPU 11 determines that printing has started when movement of the printing apparatus 1 on the printing medium P is detected by the movement detector 4, after the printing start button 3 has been pressed.

When the determination is made that printing has not started (step S106: No), the CPU 11 waits in step S105 for the next pressing of the printing start button 3.

On the other hand, when the determination is that printing has started (step S106: Yes), the CPU 11 determines whether or not the direction of movement of the printing apparatus 1 detected by the movement detector 4 is a forward direction or a reverse direction (step S107).

The forward direction is a first direction D1 for normal printing, determined in advance, and in the example in FIG. 3 and/or the like, is the direction from left to right.

The reverse direction is a second direction D2 in the opposite direction from the first direction D1 for normal printing, and in the example in FIG. 3 and/or the like, is the direction from right to left.

When the direction of movement of the printing apparatus 1 is determined to be the forward direction (step S107: Forward direction), the CPU 11 executes normal printing (step S108).

To explain more specifically, the CPU 11 causes ink to be discharged from the print head 7 in accordance with the movement of the printing apparatus 1, by sending a command to the print controller 16.

The printing unit 5 prints the print image PS such as "sample 001" shown for example in FIG. 3 on the printing medium P.

When printing of the print image PS is completed, the CPU 11 determines whether or not the print image PS in the print data includes a consecutive number portion (step S109).

To explain more specifically, the CPU 11 determines again whether or not the print image in the print data for which printing is completed includes a consecutive number portion, the same as in the determination process executed prior to the start of printing in step S102.

In step S109, the CPU 11 can use without change the result of the determination process in step S102.

When the determination is that the print image PS in the print data for which printing has been completed includes a consecutive number portion (step S109: Yes), the CPU 11 adds 1 to the numerical value of the consecutive number portion of the print image PS (step S110).

To explain more specifically, when printing of the print image PS including a consecutive number portion is completed, the CPU 11 changes the numerical value of the consecutive number portion to the value to be combined with the invariable portion of the print image PS in the next printing, by incrementing the value currently set for the numerical value of the consecutive number portion.

When the numerical value of the consecutive number portion is incremented, the CPU 11 returns to step S104 and combines the new consecutive number portion whose numerical value has been incremented with the invariable portion of the print image PS.

Then, the CPU 11 waits until the next printing starts.

When the next printing starts, the CPU 11 controls the printing unit 5 and prints on the printing medium P the print image PS in which the new consecutive number portion whose numerical value was incremented is combined.

For example, as shown in FIG. 7, when the image of "sample 001" was printed with the prior printing, for the current printing the CPU 11 causes the image of "sample 002" to be printed.

When printing of the print image PS is completed, the CPU 11 again increments the numerical value of the consecutive number portion, combines this with the print image and waits until the next printing is started.

From here, the process from step S104 through step S110 is repeated. Through this, printing of the print image PS in which the numerical value of the consecutive number portion is automatically and successively incremented can be continuously performed. In other words, an automatic numbering function is realized.

On the other hand, when the determination in step S107 is that the direction of movement of the printing apparatus 1 is the reverse direction (step S107: Reverse direction), the CPU 11 prints the correction image CP that is correction lines, for example (step S111).

To explain more specifically, the CPU 11 causes ink to be discharged from the print head 7 in accordance with movement of the printing apparatus, by sending commands to the print controller 16.

The printing unit 5 prints a sideways double line that is somewhat longer than the width of the print image for example as shown in FIG. 9, on top of the print image PS that has already been printed, as the correction image CP.

At this time, in step S111 the CPU 11 functions as the correction executor 130.

When printing of the correction image CP is completed, the CPU 11 determines whether or not the print image PS in the print data includes a consecutive number portion (step S112).

To explain more specifically, the CPU 11 determines again whether or not the print image PS in the print data for which printing is completed includes a consecutive number portion, the same as in the determination process executed in step S102 prior to the start of printing. In step S112, the CPU 11 can use without change the result of the determination process in step S102.

When the determination is that the print image PS in the print data for which printing is completed includes a consecutive number portion (step S112: Yes), the CPU 11 subtracts 1 from the numerical value set in the consecutive number portion (step S113).

To explain more specifically, when the correction image CP was printed after the print image PS including the consecutive number portion was printed, the CPU 11 returns the numerical value currently set in the consecutive number portion of the print image PS to the value at the time of the previous printing, by decrementing the numerical value currently set in the consecutive number portion of the print image PS.

When the numerical value of the consecutive number portion is decremented, the CPU 11 returns to step S104 and combines the new consecutive number portion for which the numerical value was decremented with the invariable portion of the print image PS.

Then, the CPU 11 waits until the next printing starts.

When the next printing starts, the CPU 11 controls the printing unit 5 and prints again on the printing medium P the print image PS having a consecutive number portion the numerical value of which was set to the same value as the previous time.

When printing is completed, the CPU 11 increments the numerical value of the consecutive number portion, combines this with the invariable portion of the print image PS and waits until the next printing starts.

In this manner, when the correction image CP is printed, the numerical value of the consecutive number portion is decremented, and by doing this, the user can again executing printing of the same print image PS as the previous time, without the effort of resetting the numerical value of the consecutive number portion.

On the other hand, when the determinations in step S109 and step S112 are that the print image PS in the print data for which printing is completed does not include a consecutive number portion (step S109: No; step S112: No), the CPU 11 returns to step S105 and waits until the next printing starts.

When the next printing starts, the CPU 11 controls the printing unit 5 and prints on the printing medium P the same print image PS as the previous time.

When printing of the print image PS is completed, the CPU 11 again waits in step S105 until the next printing is started.

From here, the processes from step S105 through step S109, and the processes of steps S111 and S112, are repeated.

Through this, when a printing error occurs in printing of a print image PS that does not have a consecutive number portion, correction lines, for example, are drawn as the correction image CP and printing of the same print image PS can be repeatedly performed.

As described above, when movement in the second direction that is the opposite direction to the first direction is detected after printing the print image PS on the printing medium P in accordance with movement of this apparatus (the printing apparatus 1) in the first direction, the printing apparatus 1 according to this exemplary embodiment prints correction lines indicating an occurrence of a printing error in the immediately prior printing.

Consequently, when printing errors occur due to rubbing, scraping or bending and/or the like, those can be easily corrected.

As a result, operability is improved in printing performed in accordance with movement of the printing apparatus 1.

In particular, when the printing apparatus 1, after moving in the first direction and printing the first image, again moves in the first direction without moving in the second direction, the printing apparatus 1 according to this exemplary embodiment prints the second image differing from the first image, when the print image contains a consecutive number portion.

On the other hand, when the printing apparatus 1 again moves in the first direction after moving in the second direction, an image the same as the first image is again printed, even if the print image contains a consecutive number portion.

Consequently, in printing that causes at least a portion of the print data to change each time printing is done, such as printing with an automatic numbering function, printing of the same contents as the previous time can be again performed easily, without the need to reset the print data each time a printing error occurs.

As a result, even when a printing error occurs, continuous printing can be continued without losing, to the extent possible, ease of use and operability, which are among the advantages of the manual scanning printing apparatus 1.

(Variation)

The exemplary embodiment of the present disclosure was described above, but the above-described exemplary embodiment is merely one example, and the scope of the present disclosure is not limited thereby.

That is to say, various applications of the exemplary embodiment of the present disclosure are possible, and all exemplary embodiments are included within the scope of the present disclosure.

For example, in the above-described exemplary embodiment, when the printing apparatus 1 is moved in the opposite direction to the printing direction on the printing medium P after the print image PS was printed by the printing unit 5, the correction executor 130 caused the printing unit 5 to print correction lines such as those shown in FIG. 9 as a correction image CP indicating an occurrence of a printing error in the immediately prior printing by the printing unit 5.

However, in the present disclosure, the correction image CP indicating the occurrence of the printing error is not limited to correction lines. The correction image CP may be any image with which the user can recognize the occurrence of the printing error, such as a pattern painting over the print image PS, an "x" mark, and/or the like, As a process indicating an occurrence of a printing error in printing by the printing unit 5, a notification process that notifies information indicating the occurrence of the printing error in printing by the printing unit 5 may also be executed.

For example, when the printing apparatus 1 is moved in the opposite direction to the direction at the time of printing on the printing medium P after the image of the print subject is printed by the printing unit 5, as a notification process, a process causing information indicating the occurrence of the printing error to be displayed on the display of the user interface 14, or a process outputting such information by audio from a speaker, may be executed.

As this kind of information, for example when there was a printing error in printing "sample 004", the user may be notified through a display or audio of information such as "A printing error has occurred; print sample 004 will be printed once more" or "A printing error has occurred, but print sample 005 will be printed next" and/or the like.

An approach in which notification of "Print sample 004 will be printed once more" and/or the like is done only when a determination is made that a printing error occurred, without providing any notification when printing has been completed without a printing error, may also be used. In the latter case as well, the user can recognize an occurrence of a printing error.

The second direction detected by the movement detector 4 was the opposite direction to the predetermined direction (first direction) for the printing apparatus 1 to print, in the auxiliary scanning direction of the printing apparatus 1, but the second direction may be any direction differing from the first direction.

Furthermore, when movement of the printing apparatus 1 in the second direction is detected by the movement detector 4, the correction executor 130 may, as a process indicating an occurrence of a printing error in printing by the printing unit 5, execute a printing process that causes the printing unit 5 to print the correction image CP indicating the occurrence of the printing error, in accordance with the movement in the second direction differing from the first direction.

The correction executor 130 may execute a printing process that causes printing of the correction image CP indicating an occurrence of a printing error at a position corresponding to (for example, next to) the print image PS, and need not necessarily execute a printing process that causes printing over the image of the print subject.

When the printing unit 5 prints the same image as the image of the print subject each time movement of the printing apparatus 1 in the first direction is detected by the movement detector 4, that is to say when printing is performed on the basis of the first type of print data described above, a counting process counting the number of times of movement of the printing apparatus 1 in the second direction may be executed, as a process indicating an occurrence of a printing error.

To explain more specifically, when printing of the same content is repeatedly performed, for example the same name or date and/or the like on a plurality of sheets of paper or labels and/or the like, the user causes the printing apparatus 1 to move in the opposite direction from the print direction each time a printing error occurs.

Furthermore, the number of times of movement in the opposite direction, that is to say the number of times a printing error occurred, is counted, and the counted number of times is conveyed from the display or a speaker.

Through this, when printing of the same content is repeatedly performed a predetermined number of times, the user can easily grasp how many times printing should be redone.

In the above-described exemplary embodiment, the printing unit 5 performed printing in accordance with print data having a consecutive number portion, as the second type of print data in which at least a portion of the print content changes each time printing is done.

However, in the present disclosure, the printing unit 5 may execute the above-described process on the basis of an independent plurality of print data items, without being limited to print data only a portion of which changes, such as consecutive numbers.

To explain more specifically, when the first movement in the first direction is detected, the printing unit 5 prints a first image in accordance with the first print data, and when the next movement in the first direction is detected, prints a second image in accordance with second print data, and this process is repeated.

In this manner, each time movement of the printing apparatus 1 in the first direction is detected, print subject data is selected in order from a plurality of print data items, and printing is performed.

At this time, when movement in the second direction is detected, the printing unit 5 again performs printing of the same content, with the print data printed immediately prior. Through this, even if a printing error occurs, printing of the same content as immediately prior can be again performed without resetting the print data.

In the above-described exemplary embodiment, the printing unit 5, after printing the first image, prints the same image as the first image when the printing apparatus 1 is again moved in the first direction after being moved in the second direction.

However, in the present disclosure, after the first image is printed, the printing unit 5 may print the first image when movement in the first direction is again detected by the movement detector 4 after movement by a distance that is equal to or longer than a distance of the movement when the first image was printed is detected, as the movement in the second direction.

In this case, the printing unit 5 stores the amount of movement detected by the movement detector 4 at the time of the immediately prior printing in the RAM 13.

Then, while the correction image CP is being printed by the correction executor 130, the printing unit 5 determines whether or not the amount of movement of the printing apparatus 1 has reached the amount of movement stored in the RAM 13, and thereby determines whether or not the printing apparatus 1 has moved in the reverse direction at least the same distance as the distance moved when the immediately prior image was printed.

In this manner, the printing apparatus 1 performs the next printing after being moved in the reverse direction at least the same distance as the distance moved when printing the immediately prior image, and through this can shift to the next printing after completing printing of a correction line from end to end of the image in which the printing error occurred.

In the above-described exemplary embodiment, the first direction was the direction from left to right and the second direction was the direction from right to left, but the opposite would also be fine, that is to say the first direction may be the direction from right to left and the second direction may be the direction from left to right.

Or, the first direction may be the direction from top to bottom and the second direction may be the direction from bottom to top. Thus, the first direction and the second direction are preferably at least different from each other, or the first direction and the second direction are preferably different from each other regardless of which direction the first direction specifically is.

For example, when printing characters such as Arabic characters read from right to left, for the first type of print data in the above-described exemplary embodiment or the second type of print data, the print image PS may be printed when the printing apparatus 1 is moved in the direction from right to left (the first direction), while the correction image CP may be printed when the printing apparatus 1 is moved in the direction from left to right (the second direction).

The setup may also be such that the direction from left to right is automatically set as the first direction if the characters to be printed are characters read in the direction from left to right, and the direction from right to left is automatically set as the first direction if the characters to be printed are characters read in the direction from right to left. Or, the first direction may be manually set by the user.

In the above-described exemplary embodiment, the movement detector 4 detects movement of the printing apparatus through an optical sensor having an LED.

However, the movement detector 4 may have a laser light source, read images from laser light reflected by the printing medium through an optical sensor, and detect movement of the printing apparatus 1 on the basis of changes in the images read.

Or, the movement detector 4 may detect movement of the printing apparatus through a rotary encoder. In this case, the rotary encoder is fixed to a shaft of a rotor that rotates accompanying traveling of the printing apparatus 1, for example, and movement of the printing apparatus 1 can be detected by detecting the number of rotations of the rotor.

In the above-described exemplary embodiment, the printing unit 5 performed printing using an inkjet method. However, in the present disclosure, the printing unit 5 is not limited to an inkjet method, and may be any printing unit that can print in accordance with movement of the printing apparatus on the printing medium, and for example, may perform printing using a thermal method or a thermal transfer method.

In the above-described exemplary embodiment, in the printing apparatus 1 the CPU 11 functioned respectively as the print data acquisition means, the image data setting means and the correction execution means, by executing programs stored in the ROM 12.

However, in the present disclosure, the printing apparatus 1 may, instead of the CPU 11, include dedicated hardware, for example an application specific integrated circuit (ASIC), a field-programmable gate array (FPGA), or various types of control circuits and/or the like, and the dedicated hardware may function respectively as the print data acquisition means, the image data setting means and the correction execution means.

In this case, the functions of the various components may respectively be realized by individual pieces of hardware, or the functions of the various components may together be realized by a single piece of hardware.

Of the functions of the various components, a portion may be realized by dedicated hardware and the remaining portion may be realized by software or firmware.

A configuration for realizing functions according to the present disclosure can be provided as a printing apparatus prepared in advance, or an existing information processing apparatus and/or the like can be caused to function as the printing apparatus according to the present disclosure through application of programs.

That is to say, by applying programs for causing various functional configurations of the printing apparatus 1 illustrated by the above-described exemplary embodiment to be realized to be executed by a CPU and/or the like that controls an existing information processing apparatus and/or the like, the existing information processing apparatus and/or the like can be caused to function as the printing apparatus according to the present disclosure.

The method of applying such a program is arbitrary.

The program can be stored and applied on a non-transitory computer-readable recording medium such as a flexible disk, a CD (compact disc)-ROM, a DVD (digital versatile disc)-ROM, a memory card and/or the like.

Furthermore, the program can be overlaid on carrier waves and applied via a communication medium such as the Internet and/or the like. For example, the program may be posted and distributed on a bulletin board system (BBS) on a communication network.

Furthermore, the configuration may be such that the above-described processes can be executed by activating the program and executing such similar to other application programs, under control of an operating system (OS).

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A printing apparatus comprising:

a movement detector that detects a direction of movement of the printing apparatus relative to a printing medium;

a printing unit that prints an image on the printing medium; and a processor;

wherein the processor:

causes the printing unit to print the image of a print subject on the printing medium, in a case where the movement of the printing apparatus in a first direction relative to the printing medium is detected by the movement detector; and executes a process including a notification process notifying an occurrence of a printing error in printing of the image of the print subject on the printing medium by the printing unit, in a case where the movement of the printing apparatus in a second direction differing from the first direction relative to the printing medium is detected by the movement detector after causing the printing unit to print the image of the print subject on the printing medium.

2. The printing apparatus according to claim 1, wherein the processor causes the printing unit to print a preset correction image on the printing medium, as the process indicating the occurrence of the printing error.

3. The printing apparatus according to claim 2, wherein:

the correction image is a correction line; and the processor causes the printing unit to print the correction line on the image of the print subject printed on the printing medium, as the process indicating the occurrence of the printing error.

4. The printing apparatus according to claim 1, wherein:

after causing the printing unit to print a first image as the image of the print subject on the printing medium, in a case where the movement of the printing apparatus in the first direction is again detected by the movement detector after the movement of the printing apparatus in the second direction is detected by the movement detector, the processor causes the printing unit to print the first image on the printing medium; and after causing the printing unit to print the first image as the image of the print subject on the printing medium, in a case where the movement of the printing apparatus in the first direction is again detected by the movement detector without the movement of the printing apparatus in the second direction being detected by the movement detector, the processor causes the printing unit to print a second image differing from the first image on the printing medium.

5. The printing apparatus according to claim 4, wherein after causing the printing unit to print the first image on the printing medium, in a case where the movement in a direction opposite to the first direction and by a distance that is equal to or longer than a distance of the movement of the printing apparatus when the first image was printed is detected by the movement detector and then the movement of the printing apparatus in the first direction is again detected by the movement detector, the processor causes the printing unit to print the first image on the printing medium.

6. The printing apparatus according to claim 1, wherein:

the processor causes the printing unit to print a same image as the image of the print subject on the printing medium, each time the movement of the printing apparatus in the first direction relative to the printing medium is detected by the movement detector; and counts a number of times of the movement of the printing apparatus in the second direction, and executes a process notifying the number of times counted.

7. A printing control method of a printing apparatus, including:

a movement detection step of detecting a direction of movement of the printing apparatus relative to a printing medium;

a printing step of printing an image of a print subject on the printing medium, in a case where the movement of the printing apparatus in a first direction relative to the printing medium is detected in the movement detection step; and a correction process step of executing a process including a notification process notifying an occurrence of a printing error in printing the image of the print subject on the printing medium, in a case where the movement of the printing apparatus in a second direction differing from the first direction relative to the printing medium is detected in the movement detection step after the image of the print subject is printed on the printing medium in the printing step.

8. The printing control method according to claim 7, wherein the correction process step includes a correction image printing step of printing a preset correction image on the printing medium, as the process indicating the occurrence of the printing error.

9. The printing control method according to claim 8, wherein:

the correction image is a correction line; and in the correction image printing step, the correction line is printed on the image of the print subject printed on the printing medium, as the process indicating the occurrence of the printing error.

10. The printing control method according to claim 7, wherein the printing step includes:

a first printing step wherein after a first image is printed as the image of the print subject on the printing medium, in a case where the movement of the printing apparatus in the first direction is again detected in the movement detection step after movement of the printing apparatus in the second direction is detected in the movement detection step, the first image is printed on the printing medium; and a second printing step wherein after the first image is printed as the image of the print subject on the printing medium, in a case where the movement of the printing apparatus in the first direction is again detected in the movement detection step without movement of the printing apparatus in the second direction being detected in the movement detection step, a second image differing from the first image is printed on the printing medium.

11. The printing control method according to claim 10, wherein in the first printing step, after the first image is printed on the printing medium, in a case where the movement in a direction opposite to the first direction and by a distance that is equal to or longer than a distance of the movement of the printing apparatus when the first image was printed is detected by the movement detection step and then movement of the printing apparatus in the first direction is again detected in the movement detection step, the first image is printed on the printing medium.

12. The printing control method according to claim 7, wherein:

in the printing step, the same image as the image of the print subject is printed on the printing medium, each time the movement of the printing apparatus in the first direction relative to the printing medium is detected in the movement detection step; and the correction process step includes a count notification step of counting a number of times of the movement of the printing apparatus in the second direction, and executing a process notifying the number of times counted.

13. A non-transitory computer-readable recording medium on which a printing control program for a printing apparatus is stored;

wherein the printing apparatus comprises a movement detector for detecting a direction of movement of the printing apparatus relative to a printing medium, a printing unit for printing an image on the printing medium; and a processor;

and the printing control program causes the processor to:

print the image of a print subject on the printing medium by the printing unit, in a case where the movement of the printing apparatus in a first direction relative to the printing medium is detected by the movement detector; and execute a process including a notification process notifying an occurrence of a printing error in printing of the image of the print subject on the printing medium by the printing unit, in a case where the movement of the printing apparatus in a second direction differing from the first direction relative to the printing medium is detected by the movement detector, after the image of the print subject on the printing medium is printed by the printing unit.

14. A printing apparatus comprising:

a movement detector that detects a direction of movement of the printing apparatus relative to a printing medium;

a printing unit that prints an image on the printing medium; and a processor;

wherein the processor:

causes the printing unit to print the image of a print subject on the printing medium, in a case where the movement of the printing apparatus in a first direction relative to the printing medium is detected by the movement detector; and executes a process indicating an occurrence of a printing error in printing of the image of the print subject on the printing medium by the printing unit, in a case where the movement of the printing apparatus in a second direction differing from the first direction relative to the printing medium is detected by the movement detector after causing the printing unit to print the image of the print subject on the printing medium;

wherein:

after causing the printing unit to print a first image as the image of the print subject on the printing medium, in a case where the movement of the printing apparatus in the first direction is again detected by the movement detector after the movement of the printing apparatus in the second direction is detected by the movement detector, the processor causes the printing unit to print the first image on the printing medium; and after causing the printing unit to print the first image as the image of the print subject on the printing medium, in a case where the movement of the printing apparatus in the first direction is again detected by the movement detector without the movement of the printing apparatus in the second direction being detected by the movement detector, the processor causes the printing unit to print a second image differing from the first image on the printing medium.

15. A printing control method of a printing apparatus, including:

a movement detection step of detecting a direction of movement of the printing apparatus relative to a printing medium;

a printing step of printing an image of a print subject on the printing medium, in a case where the movement of the printing apparatus in a first direction relative to the printing medium is detected in the movement detection step; and a correction process step of executing a process indicating an occurrence of a printing error in printing the image of the print subject on the printing medium, in a case where the movement of the printing apparatus in a second direction differing from the first direction relative to the printing medium is detected in the movement detection step after the image of the print subject is printed on the printing medium in the printing step;

wherein the printing step includes:

a first printing step wherein after a first image is printed as the image of the print subject on the printing medium, in a case where the movement of the printing apparatus in the first direction is again detected in the movement detection step after movement of the printing apparatus in the second direction is detected in the movement detection step, the first image is printed on the printing medium; and a second printing step wherein after the first image is printed as the image of the print subject on the printing medium, in a case where the movement of the printing apparatus in the first direction is again detected in the movement detection step without movement of the printing apparatus in the second direction being detected in the movement detection step, a second image differing from the first image is printed on the printing medium.

* * * * *